US006863507B1

(12) United States Patent
Schaeffer et al.

(10) Patent No.: US 6,863,507 B1
(45) Date of Patent: Mar. 8, 2005

(54) GENERIC FREE-PISTON ENGINE WITH TRANSFORMER VALVE ASSEMBLY FOR REDUCING THROTTLING LOSSES

(75) Inventors: Rudolf Schaeffer, Marktheidenfeld (DE); Joerg Dantlgraber, Lohr/Main (DE)

(73) Assignee: Mannesmann Rexroth AG, Lohr (DE)

( * ) Notice: Subject to any disclaimer, the term of this patent is extended or adjusted under 35 U.S.C. 154(b) by 0 days.

(21) Appl. No.: 10/130,037

(22) PCT Filed: Nov. 6, 2000

(86) PCT No.: PCT/DE00/03886

§ 371 (c)(1),
(2), (4) Date: Jun. 26, 2002

(87) PCT Pub. No.: WO01/38706

PCT Pub. Date: May 31, 2001

(30) Foreign Application Priority Data

Nov. 24, 1999 (DE) ..... 199 56 547

(51) Int. Cl.[7] ..... F04B 35/00
(52) U.S. Cl. ..... 417/364; 123/46 R
(58) Field of Search ..... 417/364, 374, 417/375, 390, 392, 244, 265, 268, 321, 324, 339, 340, 380, 486, 487, 488; 123/46 R, 46 A, 46 B, 46 SC, 46 E, 46 H; 92/191, 220, 221

(56) References Cited

U.S. PATENT DOCUMENTS

| | | | | |
|---|---|---|---|---|
| 3,065,703 A | * | 11/1962 | Harman | 103/44 |
| 3,606,591 A | | 9/1971 | Potma | |
| 4,166,410 A | | 9/1979 | Schlosser | |
| 4,202,251 A | | 5/1980 | Geirnaert | |
| 4,205,638 A | | 6/1980 | Vlacancinch | |
| 4,307,999 A | * | 12/1981 | Vanderlaan | 417/324 |
| 4,382,748 A | * | 5/1983 | Vanderlaan | 417/11 |
| 4,435,133 A | * | 3/1984 | Meulendyk | 417/364 |
| 4,620,836 A | | 11/1986 | Brandl | |
| 5,482,445 A | | 1/1996 | Achten et al. | |
| 5,556,262 A | * | 9/1996 | Achten et al. | 417/364 |
| 5,971,027 A | * | 10/1999 | Beachley et al. | 138/31 |
| 5,983,638 A | * | 11/1999 | Achten et al. | 60/595 |
| 6,076,506 A | * | 6/2000 | Berlinger et al. | 123/46 SC |
| 6,279,517 B1 | * | 8/2001 | Achten | 123/46 R |
| 6,314,924 B1 | * | 11/2001 | Berlinger | 123/46 R |

FOREIGN PATENT DOCUMENTS

| | | |
|---|---|---|
| CH | 474665 | 4/1969 |
| DE | 2715896 A1 | 10/1978 |
| DE | 3327334 A1 | 2/1985 |
| DE | 4024591 A1 | 2/1992 |
| EP | 0045472 B1 | 3/1986 |
| EP | 0613521 B1 | 1/1996 |
| WO | WO 96/03576 | 2/1996 |
| WO | WO 98/54450 | 12/1998 |
| WO | WO 99/34100 | 7/1999 |

* cited by examiner

*Primary Examiner*—Charles G. Freay
(74) *Attorney, Agent, or Firm*—Oliff & Berridge, PLC

(57) ABSTRACT

A free-piston engine directed to reduced throttling losses at minimum expenditure is provided. The free-piston engine has an engine piston, and a hydraulic piston co-operating with the engine piston. The engine piston may receive application of a force in the direction of compression via a hydraulic cylinder. A pressure in a high-pressure accumulator means or a low-pressure accumulator may be communicated to the hydraulic cylinder via a switchover valve. Between the hydraulic cylinder and the switchover valve is a valve assembly including a control piston. A connection to the high-pressure accumulator means may be controlled open with the aid of the control land of the control piston.

12 Claims, 11 Drawing Sheets

GENERIC FREE-PISTON ENGINE WITH TRANSFORMER VALVE ASSEMBLY FOR REDUCING THROTTLING LOSSES

A free-piston engine fundamentally is a combustion engine working according to the 2-cycle method and having not a crankshaft drive but a hydraulic circuit including a reciprocating pump as its subsequently arranged drive train. The engine piston is connected to a hydraulic cylinder whereby the translatory energy generated during a work cycle of the engine is supplied directly to the hydraulic work medium, without the classical by-way of the rotary movement of a crankshaft drive. The subsequently arranged, storage-capability hydraulic circuit is designed such as to absorb the output power and buffer it for supplying it to a hydraulic output unit, e.g., an axial piston engine, in accordance with power demand.

In DE 40 24 591 A1 a free-piston engine of the generic type is described, also known as a Brandl free-piston engine. In the case of this concept, the compression movement of the engine piston takes place through co-operation with a hydraulic piston which may be connected to a high-pressure accumulator or a low-pressure accumulator via a 2/3-way switchover valve. At the beginning of the compression stroke, an acceleration of the engine piston takes place through applying pressure from the high-pressure accumulator to the hydraulic cylinder. Once a predetermined engine piston velocity is reached, the hydraulic cylinder is connected to the low-pressure accumulator via the switchover valve, so that the further compression stroke of the engine piston takes place against the effective force from the compression pressure of the work gas. After the outer dead center (AT) has been reached, the work gas is ignited, and the engine piston is accelerated towards the inner dead center (IT). During this piston movement from AT to IT, the connection with the high-pressure accumulator is controlled open via the switchover valve, whereby the engine piston is decelerated and the kinetic energy thereof is converted to potential hydraulic energy, and the high-pressure accumulator is charged. Although the response times of the switchover valve are in the milliseconds range, throttling losses possibly in the order of 10% of the engine power are engendered in the switchover valve by controlling the connection to the high-pressure accumulator between open and closed.

The drawback of the Brandl free-piston engine may be overcome with the aid of another free-piston design, the so-called INNAS engine as disclosed, e.g., in EP 0613521 B1. Such an engine does, however, have an extremely complex structure, resulting in a substantially higher degree of capital expenditure in terms of device technology than in the case of a Brandl engine.

In view of the above, the invention is based on the object of further developing the generic free-piston engine with a view to reduced throttling losses at minimum expenditure in terms of device technology.

According to the invention, a valve assembly including a control piston is arranged between a hydraulic cylinder accommodating a hydraulic piston and a switchover valve for selective hydraulic connection of the hydraulic cylinder with a high-pressure accumulator means or a low-pressure accumulator, whereby a pressure force depending on the output pressure at the switchover valve or on a pressure from the high-pressure accumulator may be applied to the hydraulic piston.

As for controlling the engine piston it merely is necessary to increase or decrease the pressure acting on the valve body of the transformer valve assembly, the switchover valve may be designed for a substantially lower flow than in the prior art, so that short switching times may be realized at minimum throttling losses.

In accordance with the invention, the control piston is designed to include a control land whereby a connection to the high-pressure accumulator may be controlled open. The control piston thus procures its switching energy via its own control land from the high-pressure accumulator means, so that the quantity of pressure medium flowing across the switchover valve is required solely for initiating the opening movement of the control piston, and thus is minimum.

As a result of the intermediate arrangement of the valve assembly in accordance with the invention, the quantities flowing across the switchover valve may be minimized, so that the pressure losses upon opening and closing the connection to the high-pressure accumulator are minimum.

The area of cross-section of the control piston is advantageously formed to be larger than that of the hydraulic piston, so that due to the selected transformation ratio a comparatively small stroke of the control piston is enough for effecting a sufficient acceleration of the engine piston.

In an alternative embodiment, the opening movement of the control piston is limited by a stop. After the control piston contacts this stop, no more pressure build-up takes place in the hydraulic cylinder, so that no further acceleration of the engine piston takes place. I.e., in accordance with the invention, the closing actuation of the switchover valve as required in the prior art is replaced with the control piston contacting the stop, so that the throttling losses occurring during closing of the switchover valve practically cannot occur. This stop may be made to be adjustable to allow for adaptation of the maximum velocity of the engine piston.

Resetting the control piston during the combustion stroke substantially is effected through the force of the control spring, with enough time being available for this closing action, and throttling losses also virtually not occurring.

Charging of the high-pressure accumulator means during the combustion stroke of the engine piston takes place through a high-pressure passage having a check valve provided in it. This high-pressure passage may in one embodiment of the free-piston engine in accordance with the invention be controlled open and closed via another control land of the control piston, so that the charging process is not dependent on the position of the control piston.

In accordance with an advantageous development of the free-piston engine in accordance with the invention, it is possible to provide in the high-pressure passage leading to the high-pressure accumulator means a directional valve whereby a bypass line bypassing the check valve provided therein may be controlled open or closed. As a result of this directional valve, the hydraulic piston may be subjected directly to pressure from the high-pressure accumulator means during the compression stroke, whereas the control piston initially remains in its closed position. After the hydraulic piston reaches a predetermined acceleration or velocity, the bypass line is then controlled closed, so that the further movement of the hydraulic piston is determined by the control piston in the above described manner.

The directional valve may optionally be provided with a switching-position in which the high-pressure passage is capable of being connected to the reservoir, so that the free piston may be displaced in the direction of its inner dead center virtually in the absence of any forces due to counterpressure.

In another advantageous variant of the free-piston engine, the control piston has the form of a step piston, with the annular surface acting in the direction of opening being connected to the low-pressure accumulator via the low-pressure passage including a check valve. In the direction of closing, the larger annular end face of the control piston is subjected to the pressure in the hydraulic cylinder of the hydraulic piston and to the force of the control spring. In this variant, pressure medium is drawn in from the low-pressure accumulator during the entire opening movement of the control piston. On account of this uniform replenishing of pressure medium over practically the entire range of displacement of the control piston, cavitations in the hydraulic cylinder can be prevented for replenishing essentially takes place when the hydraulic piston or engine piston has reached its maximum velocity when the control piston contacts the stop.

The annular space of the step piston is connected to the high-pressure accumulator via a pressure passage, so that charging of the high-pressure accumulator means is effected during the return movement of the control piston.

The rear peripheral edge of the larger end face of the stepped control piston is preferably formed such that the latter controls open the high-pressure passage shortly before the control piston contacts its valve seat, so that the kinetic energy of the engine piston or hydraulic piston, respectively, is utilized for charging the high-pressure accumulator means.

Preliminary trials showed that the pressure in the high-pressure accumulator means may fluctuate relatively strongly due to other connected consumers, which may bring about unsteady states during the compression stroke of the free-piston engine. In order to overcome this drawback, it is suggested in another advantageous variant to design the high-pressure accumulator means with as a medium-high pressure accumulator and a high-pressure accumulator, wherein the energy required for the compression stroke is drawn from the medium-high pressure accumulator. The latter is connected to the high-pressure accumulator through suitable valve means and is kept at a pressure level situated below the minimum level of the high-pressure accumulator. When a limit pressure is exceeded, the pressure in the medium-high pressure accumulator may be relieved towards the low-pressure accumulator.

In the course of the return movement of the engine piston towards the inner dead center, the high-pressure accumulator feeding the medium-pressure accumulator is then advantageously charged.

In another variant of the free-piston engine in accordance with the invention, the hydraulic piston is designed as a differential piston, wherein an annular space defined by the differential piston and the annular space of a stepped control piston are capable of being connected with the low-pressure accumulator during the expansion stroke and during the compression stroke, respectively.

The free-piston engine in accordance with the invention may be given a particularly compact form if the transformer valve assembly is arranged coaxial with the engine piston axis.

The valve assembly preferably is designed as a logic valve or as a spool valve.

Preferred embodiments of the invention are hereinbelow explained in more detail by referring to schematic drawings, wherein.

Figure 1:
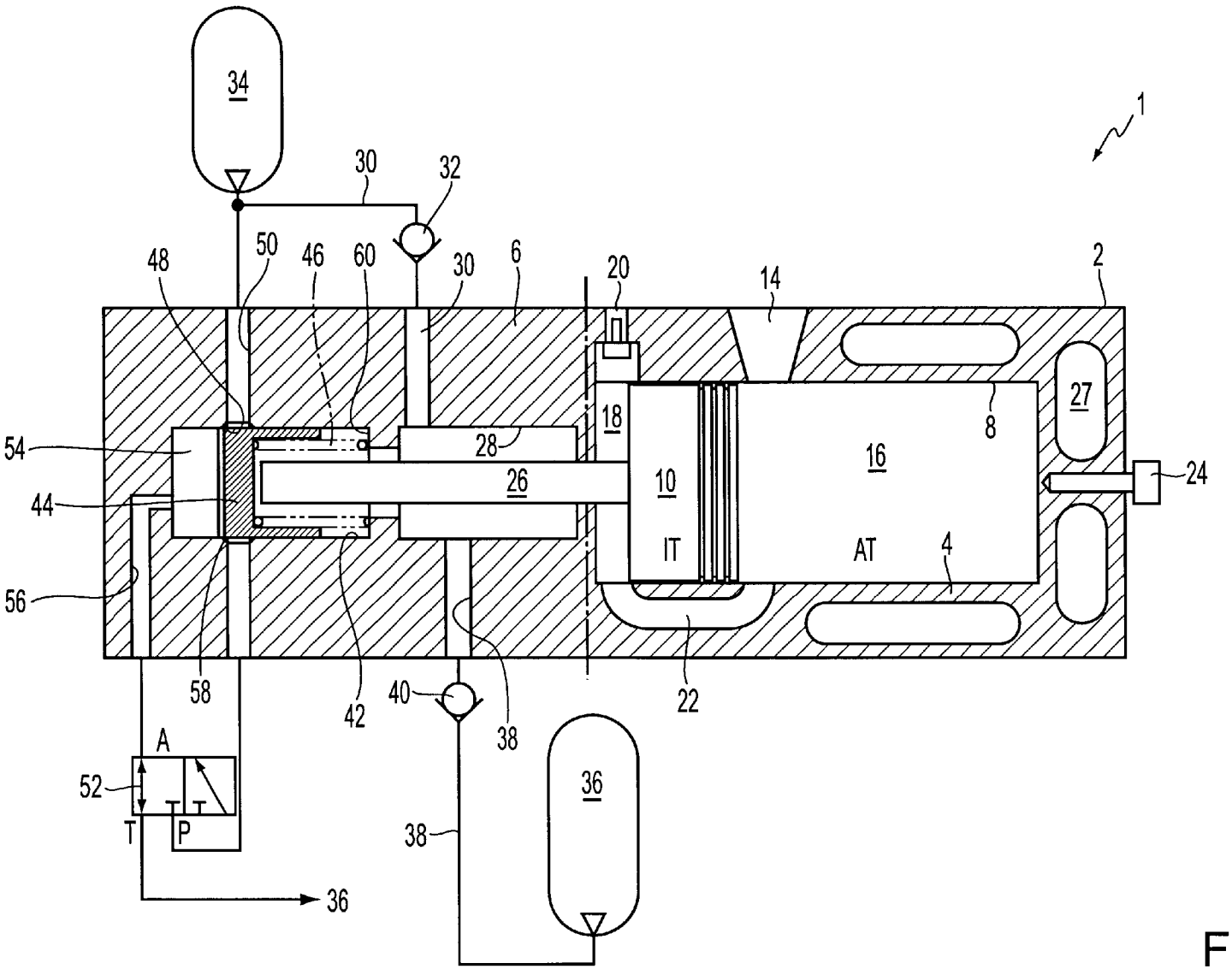
FIG. 1 is a schematic representation of a first embodiment of a free-piston engine.

FIG. 1 shows a strongly simplified, schematic representation of a free-piston engine in accordance with the invention. It comprises an engine housing 2 defining at least one combustion cylinder 4 (to the right of the dash-dotted line in FIG. 1) and a hydraulic cylinder 6 (to the left of the dash-dotted vertical line).

In a cylinder bore 8 of the combustion cylinder 4 an engine piston 10 is guided, whereby the cylinder bore 8 is subdivided into a combustion chamber 16 and an intake chamber 18. In the represented stand-by position of the free-piston engine 1, the engine piston 10 is located at its inner dead center (IT), with an outlet passage 14 being controlled open, so that combustion gases may flow out from the combustion chamber 16. The supply of fresh gas takes place via an intake passage 20 opening into the rear intake chamber 18 and including an intake valve. The intake chamber 18 and the combustion chamber 16 are communicated with the aid of an overflow passage 22.

Injection of the fuel into the combustion chamber 16 is effected through an injection valve 24 in the cylinder head of the combustion cylinder 4. For cooling of the free-piston engine 1, cooling channels 27 are formed in the peripheral wall of the combustion cylinder 4. So far, the free-piston engine 1 corresponds to a conventional two-stroke engine.

The engine piston 10 carries a hydraulic piston 26 having a diameter substantially smaller than that of the engine piston 10. This hydraulic piston 26 plunges into a stepped axial bore 28 of the hydraulic cylinder 6.

In the connecting bore through which the hydraulic piston 26 extends, between the axial bore 28 and the intake room 18, suitable seal means are provided, so that the media received in the combustion cylinder 4 and in the hydraulic cylinder 6 are separated from each other.

Into the axial bore 28 of the hydraulic cylinder there opens a radially arranged high-pressure passage 30 which is connected to a high-pressure accumulator 34 via a check valve 32. Correspondingly, a low-pressure accumulator 36, for instance a pressure medium tank, is connected to the space defined by the axial bore 28 via a low-pressure passage 38 and a check valve 40. Check valve 40 precludes a return flow of the pressure medium received in the axial bore 28 to the low-pressure accumulator 36, while check valve 32 prevents a return flow of the pressure medium received in the high-pressure accumulator 34 into the axial bore 28.

The hydraulic piston 26 extends through the axial bore 28 and plunges into a control space 42 in which a control piston 44 having the form of a logic piston is guided. In the transformer valve assembly the control piston is biased against a valve seat 48 through the intermediary of a control spring 46.

Into the range of the control space 42 adjacent the valve seat 48 there opens a pressure passage 50 connected to the high-pressure accumulator 34 on the one hand and to an inlet port P of a switchover valve 52 on the other hand.

A pilot space 54 adjacent the end face of the control piston 44 is connected to an outlet port or work port A of the switchover valve 52 via a control passage 56. This outlet port or work port has the form of an electrically or electro-hydraulically actuated 3/2-directional valve which may be controlled through the engine control (not shown). Apart from the above described outlet and pressure ports A, P, the switchover valve 52 moreover includes a reservoir port T which is connected to a reservoir or to the low-pressure accumulator 36.

In the represented basic position of the switchover valve 52, the reservoir port T and the work port A are interconnected while the pressure port P is blocked. In one switching position of the switchover valve 52, the pressure port P is connected with the work port A and the reservoir port T is blocked. In accordance with FIG. 1, the control piston 44 is seated on the valve seat 48 in a basic position of the free-piston engine 1, so that the pilot space 54 and the control space 42 are blocked from each other. Herein the control piston 44 of the logic valve receives application of the force of the control spring 46 and of the pressure in the axial bore 28 and thus in the rear control space 42 in the direction of closing, while receiving the pressure in the pilot space 54 acting in the direction of opening.

If the pressure prevailing in the low-pressure 10 accumulator 36 acts in the pilot space 54 and in the control space 42, the control piston 44 is thus urged against the valve seat 48 essentially by the force of the spring.

In the combustion chamber 16, fresh gas is present which was displaced out of the intake room 18 through the overflow passage 22.

Figure 2:
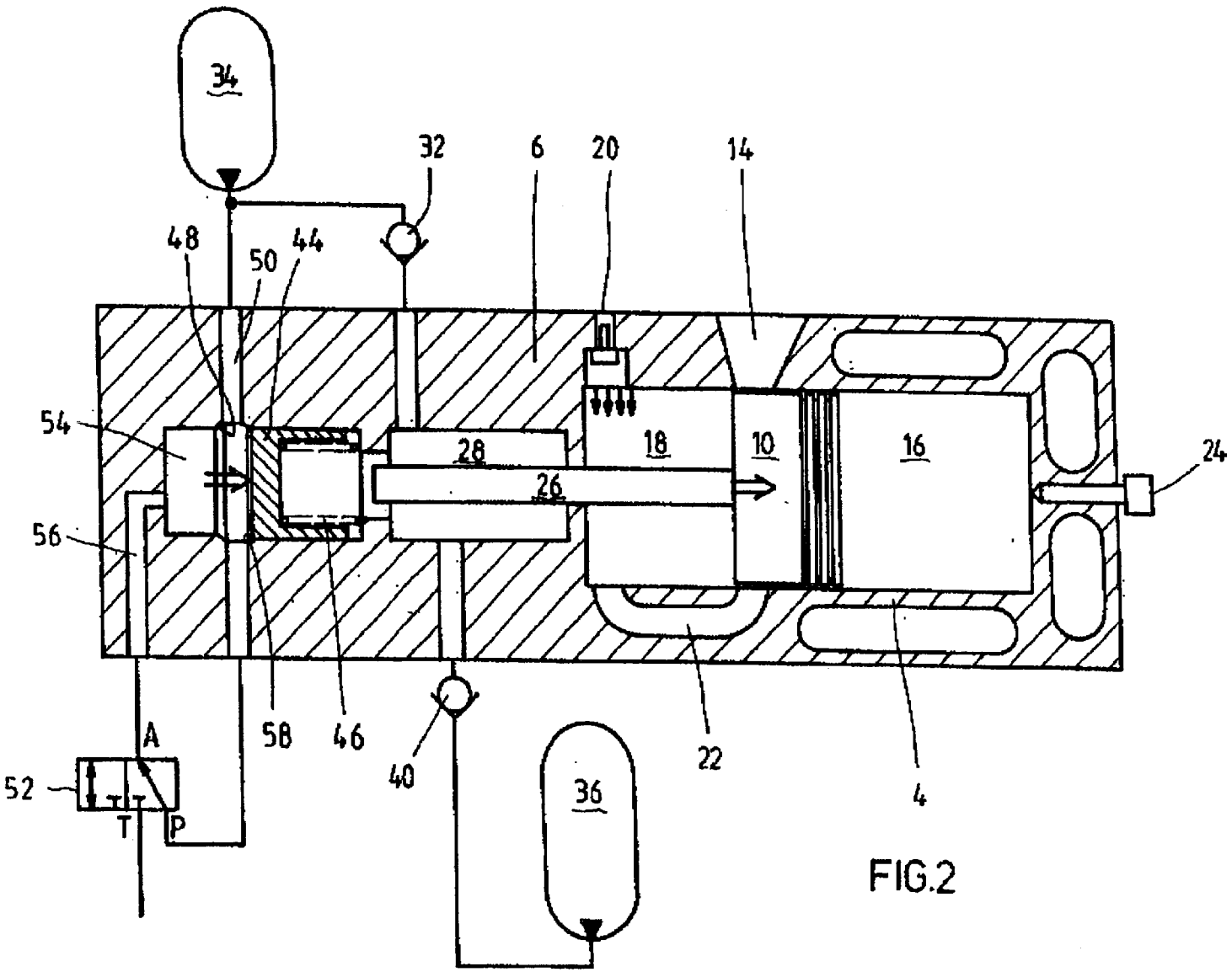
FIGS. 2 to 6 show various working phases of the embodiment represented in FIG. 1.

For compression of the fresh gas, the switchover valve 52 is taken by the engine control into a second switching position wherein in accordance with FIG. 2 the pressure port P is communicated with the work port A, so that pressure medium from the high-pressure accumulator 34 is fed into the pilot space 54 via the pressure passage 50 and the control passage 56. I.e., the end face of the control piston 44 is subjected to high pressure while low pressure is still acting in the control space 42. On account of the pressure difference, the control piston 44 is raised from its valve seat 48, and the connection between the pilot space 54 and the pressure passage 50 is controlled open through the control land 58 formed by the peripheral edge of the control piston 44. The control piston thus obtains kinetic energy with acceleration as a function of the control land opening, through which the end face of the control piston 44 is directly subjected to the pressure in the high-pressure accumulator 34. Due to the resulting axial displacement of the control piston 44, the hydraulic piston 26 is also accelerated and the engine piston 10 is moved to the right in the representation of FIG. 2: the outlet passage 14 and the overflow passage 22 are controlled closed by the engine piston 10, and the fresh gas present in the combustion room 16 is compressed.

By the check valve 40 pressure medium is prevented from leaving the axial bore 28 into the low-pressure accumulator 36 during the compression piston movement.

As a result of the displacement of the engine piston 10 towards the outer dead center AT, fresh gas is drawn into intake chamber 18 through the intake passage 20.

Figure 3:
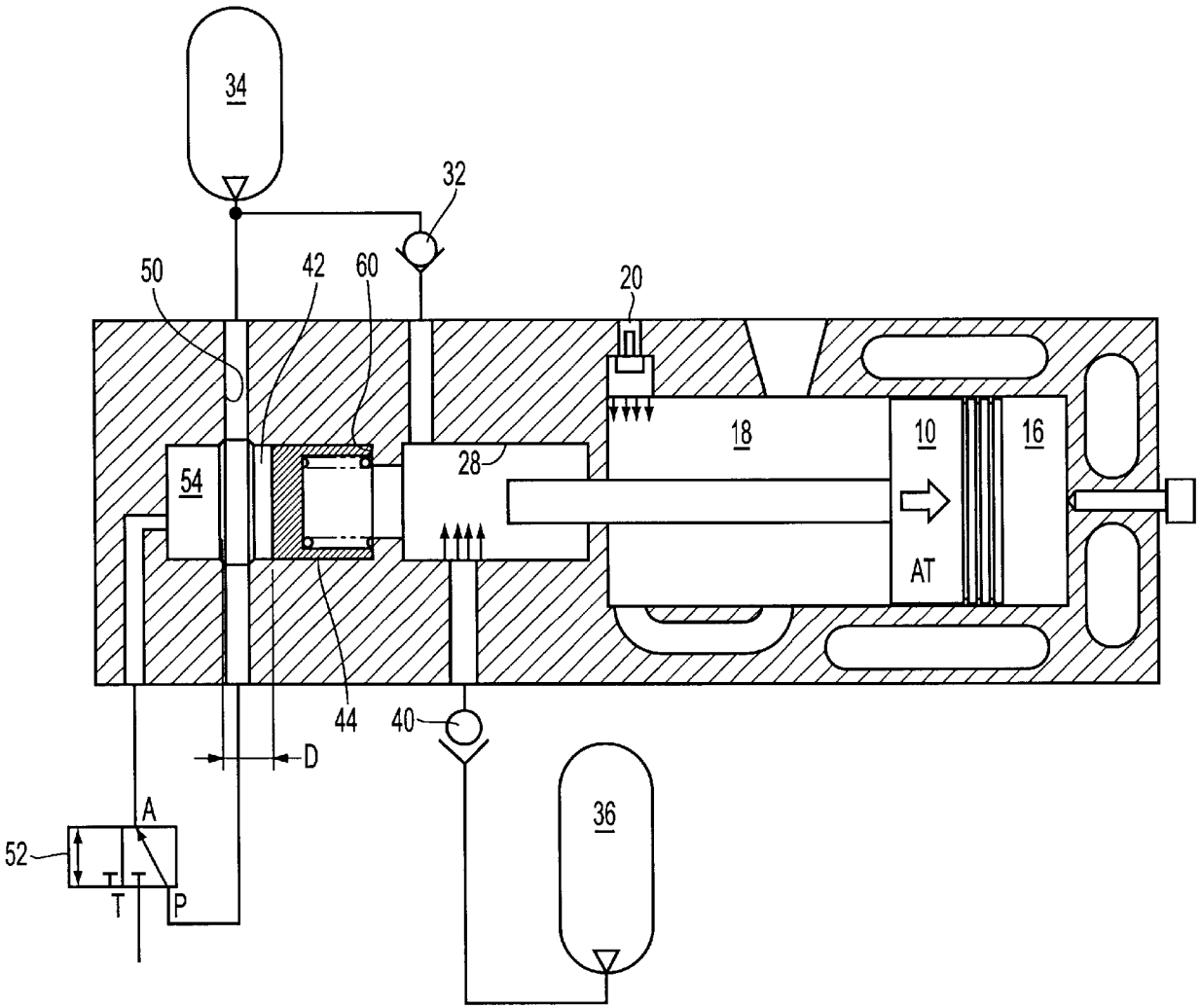

In accordance with FIG. 3, the control piston 44 contacts a stop 60 in the control space 42 after a predetermined travel distance D. The engine piston 10, which has been accelerated to its maximum velocity, continues to move towards the AT owing to its kinetic energy, with pressure medium being drawn in from the low-pressure accumulator 36 via the check valve 40 and the low-pressure passage 38 because of the low pressure forming in the axial bore 28. The position of the stop 60 is selected such that the kinetic energy of the engine piston 10 at the time of the control piston 44 contacting the stop 60 is sufficient for moving the engine piston 10 towards the AT against the polytropically increasing reaction force due to the compressing of the fresh gas in the combustion chamber 16. In the process, the engine piston 10 is decelerated by the reaction force and comes to a standstill at the AT.

Figure 4:
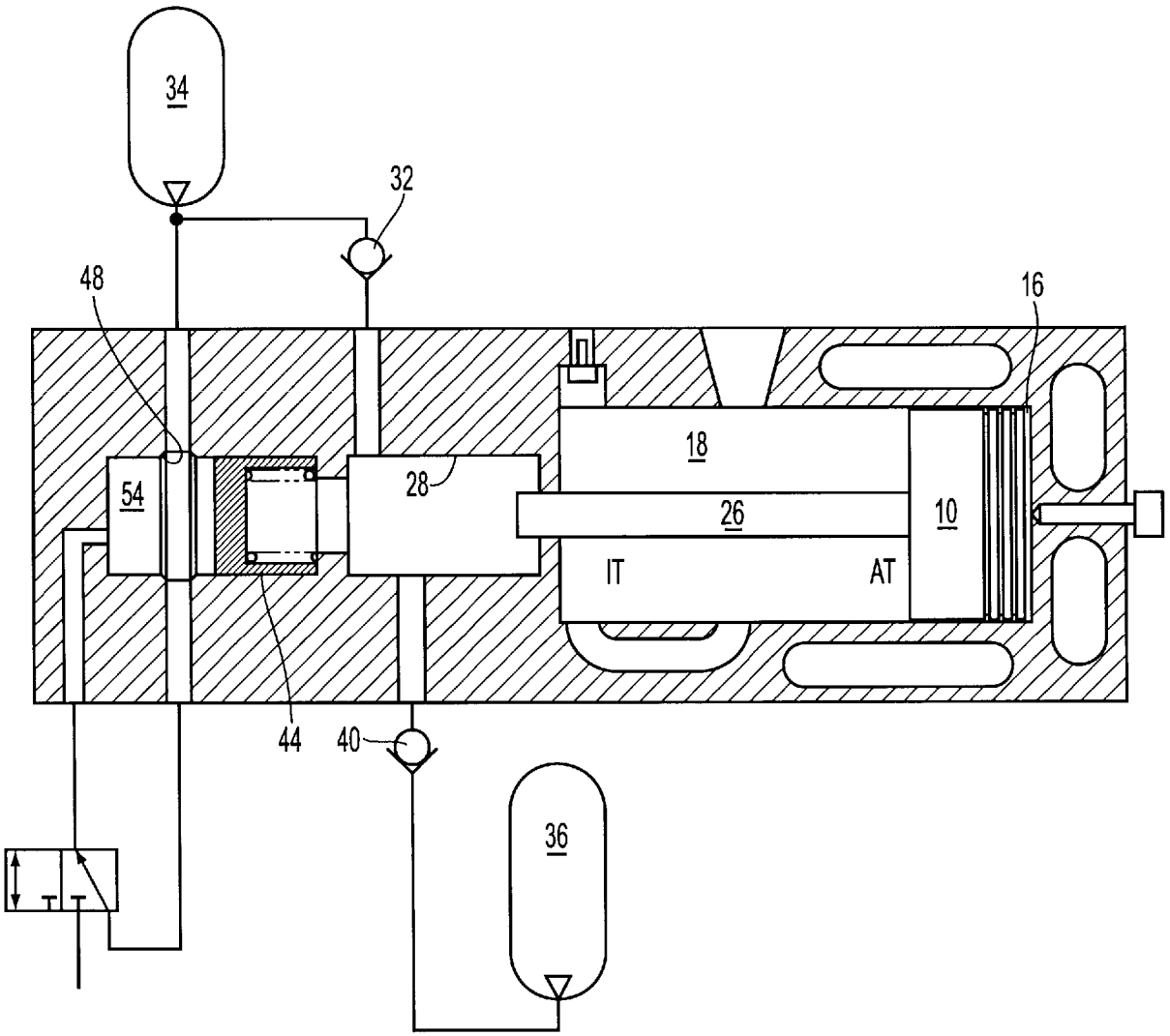
Figure 5:
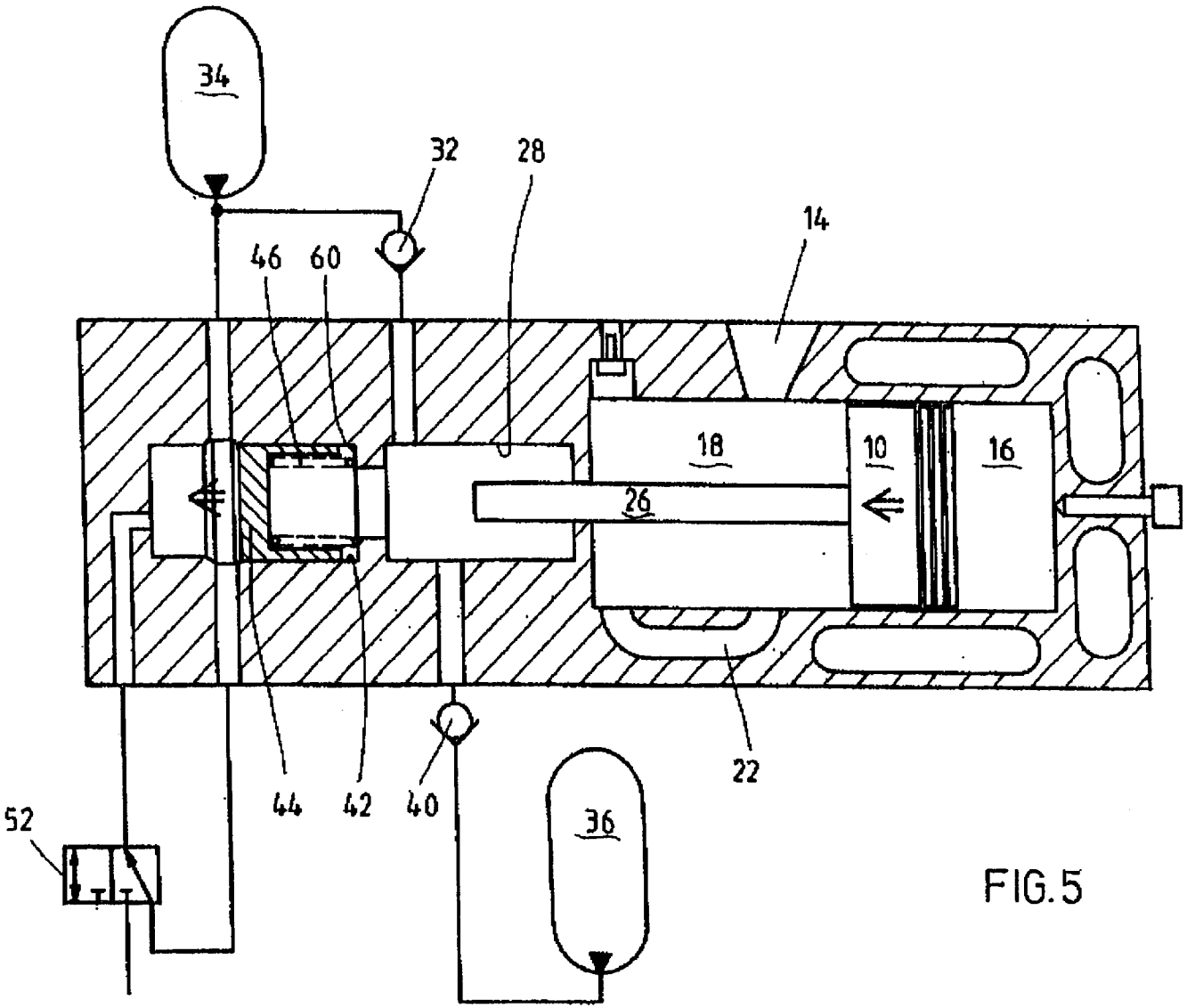
Figure 6:
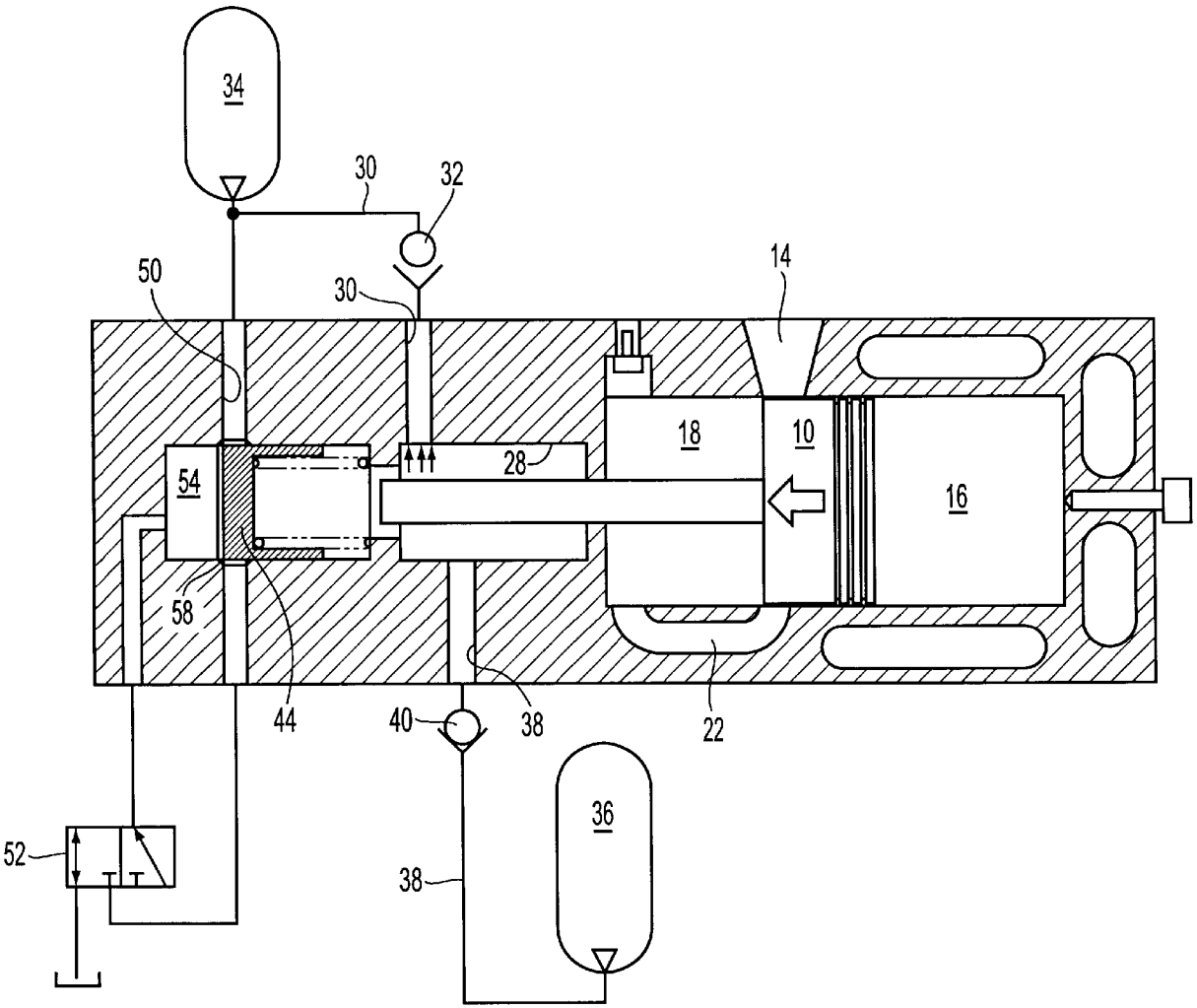

This phase is represented in FIG. 4. As soon as the engine piston 10 stops at its AT, fuel is injected into the combustion chamber 16 and ignited by the high temperature of the fresh gas, so that the engine piston is accelerated from the AT in the direction towards the IT by the combustion pressure building up in the combustion chamber 16 (FIG. 5). Due to the resulting displacement of the hydraulic piston 26 towards the control piston 44, a pressure builds up in the axial bore 28 and thus in the control space 42, which pressure is approximate to the pressure in the accumulator 34 minus the pressure equivalent of the spring 46, so that by the force resulting from this pressure and the force of the control spring 46, the control piston is raised from its stop 60, displaced by the distance D, and urged against its valve seat 48. Hereby the direct connection towards the high-pressure accumulator 34 is controlled closed, so that the high pressure continues to act on the control piston 44 in the opening direction thereof merely through the switchover valve which is in its represented switching position.

After closing of the logic valve, the pressure in the axial bore 28 and in the control space 42 rises to a higher pressure than prevailing in the accumulator 34. The further movement of the engine piston 10 and of the hydraulic piston 26 takes place against this pressure, so that the kinetic energy of the decelerating engine piston 10 is converted into fluid pressure for charging the high-pressure accumulator. Due to the pressure rise while the logic valve is closed, the check valve 32 is opened and the high-pressure accumulator 34 is charged via the high-pressure passage 30. Nearly the entire kinetic energy of the engine piston 10 is thus converted into potential hydraulic energy and directly fed into the high-pressure accumulator 34. During the movement of the engine piston 10 towards its IT, the outlet passage 14 and the overflow passage 22 are controlled open, so that fresh gas enters through the overflow passage 22 into the combustion chamber 16, and the exhaust gas is scavenged through the outlet passage 14.

Upon reaching the IT, the switchover valve 52 is switched into its basic position, so that the end face of the control piston 44 receives application of low pressure. The piston position and pressure conditions now correspond to the initial conditions as described by referring to FIG. 1. By switching the switchover valve 52, a new work cycle may begin.

Referring again to FIGS. 2–5, during operation of the engine in a plurality of directly subsequent cycles, the valve 52 need not be switched but may remain in the same position (i.e., the position shown in FIGS. 2–5). Therefore, the valve 52 does not have to be switched after each cycle.

The acceleration of the engine piston 10 and thus the compression ratio of the free-piston engine 1 in the above described cycle is essentially influenced by the length of the distance D covered by the control piston 44 in the acceleration phase. In order to always attain an identical compression ratio during engine operation irrespective of the pressure in the high-pressure accumulator 34, the stop 60 for the control piston 44 may be designed to be adjustable. Such adjustment may, for example, be effected through the engine control.

Figure 7:
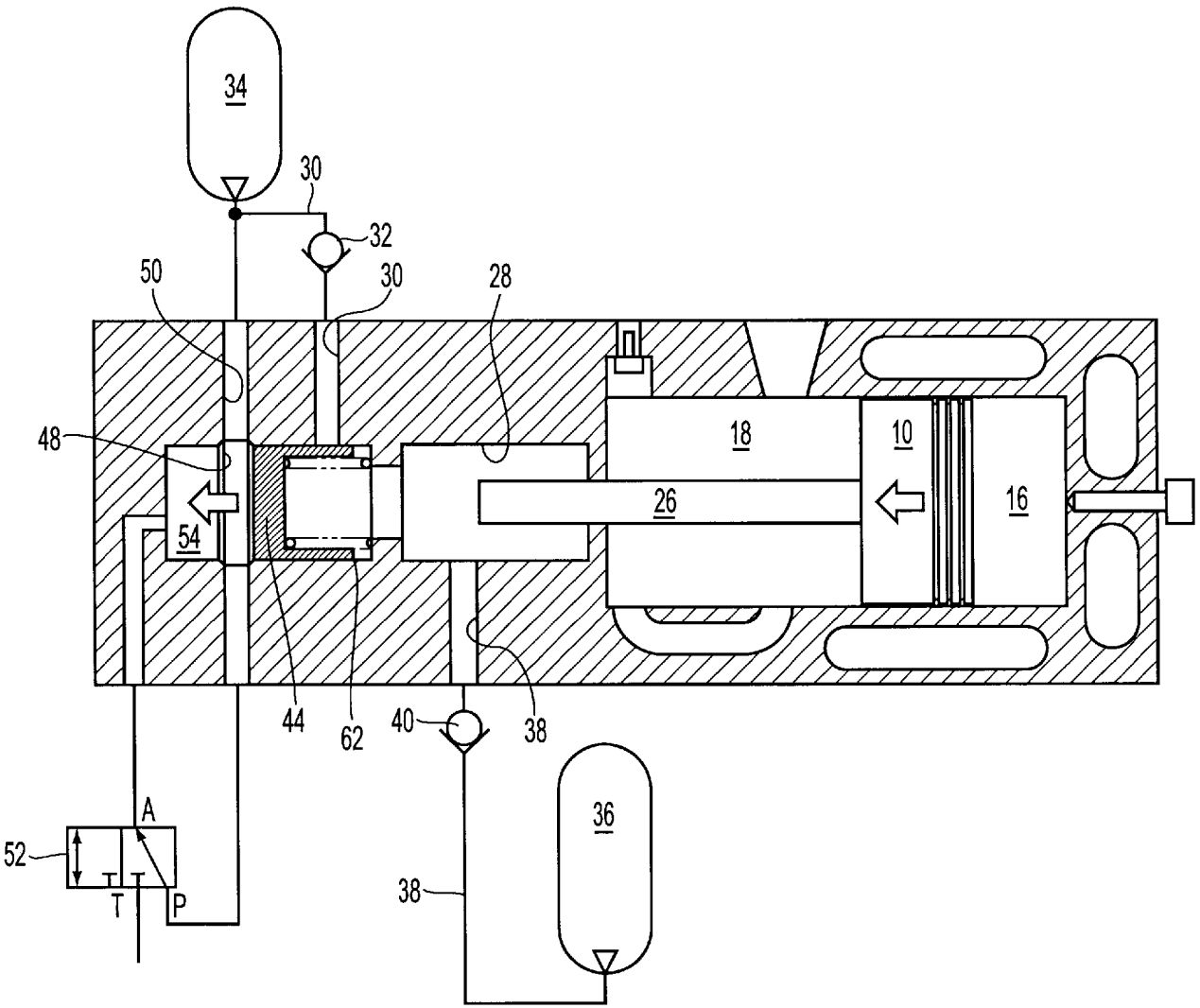
FIG. 7 shows a second embodiment of a free-piston engine in accordance with the invention.

In the variant represented in FIG. 7, the high-pressure passage 30 opens into the control space 42. This has the effect of the high-pressure passage 30 being controlled open and closed by another control land 62 formed on the piston jacket of the control piston 44, so that the control movement of the control piston 44 is further optimized, and rapid closure of the logic valve is ensured. The second embodiment represented in FIG. 7 corresponds to the above described first embodiment, so that further explanations are superfluous.

Instead of the logic valve (seat valve) employed in the above described embodiments it is, of course, also possible to use a spool valve.

In the above described embodiments, the axis of the logic valve is designed coaxial with the axis of the combustion cylinder. It is, of course, also possible to realize other relative positions in which hydraulic connection with the hydraulic cylinder 6 is ensured.

Figure 8:
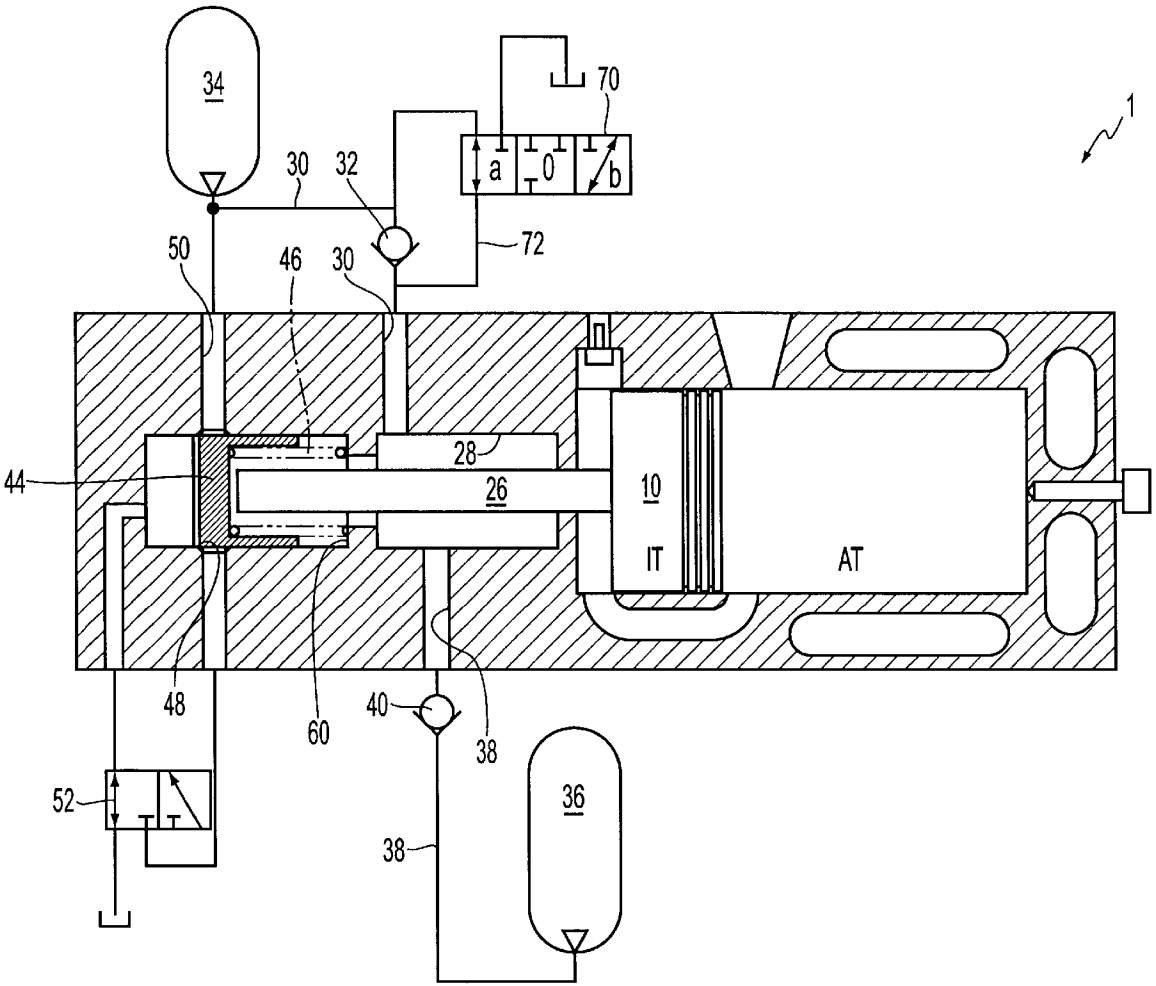
FIG. 8 shows a third embodiment of a free-piston engine including a directional valve for hydraulic limitation of the engine piston velocity.

In FIG. 8 a third embodiment of a free-piston engine is represented where the hydraulic piston, or work piston 26, may directly receive application of a high pressure from the high-pressure accumulator 34 via a directional valve 70. The basic structure of the free-piston engine represented in FIG. 8 corresponds to the embodiment represented in FIG. 1, so that in the following only the newly added components shall be described. In accordance with FIG. 8, the check valve 32 may be bypassed via a bypass line 72 having the directional valve 70 positioned therein. In the represented embodiment, the directional valve is designed with three switching positions, with the bypass line 72 being opened and a connection to the reservoir being blocked in switching position a. In the basic position 0, the connection towards both the reservoir and the bypass line 72 are blocked. In the switching position designated with b, the range of the high-pressure passage 30 upstream from the check valve 32 may be connected with the reservoir, so that the pressure in the axial bore 28 may be relieved towards the reservoir.

In order to initiate the compression stroke in the above described embodiments, the switchover valve 52 is taken to the work position, so that the left-hand end face of the control piston 44 is subjected to the pressure in the high-pressure accumulator 34. The directional valve 70 is taken into the one represented switching position in which the check valve 32 is bypassed, so that the pressure in the hydraulic accumulator 34 also acts in the axial bore 28 and thus on the rear side of the control piston 44. Owing to the hydraulic equilibrium of forces, the control piston 44 is then biased into its closing position by the force of the control spring 46.

Due to the pressure in the axial bore 28, the hydraulic piston 26 is accelerated, whereby the compression stroke of the engine piston 10 is initiated. After the hydraulic piston 26 and/or the engine piston 10 reaches a predetermined maximum velocity, e.g. 5 m/s, the directional valve 70 is taken into its blocking position designated by 0, so that the bypass life 72 is blocked and pressure medium supply from the high-pressure accumulator 34 into the axial bore 28 is prevented. Subsequently the control piston 44 rises from its valve seat 48, so that the further movement of the engine piston 10 is determined by the axial displacement of the control piston 44.

Thanks to the intermediate arrangement of the directional valve 70 it is thus possible to set a variable initial velocity of the engine piston 10 before the control piston 44 takes effect. This variable initial velocity may be adapted as a function of the operating conditions and the opening stroke and of the opening time by controlling the directional valve 70.

At long opening times of the bypass line 72 it is possible to make do with comparatively small axial displacements of the control piston 44, so that a more compact design is possible. To this end, however, the directional valve 70 must be made to have a correspondingly large nominal width. In a case where relatively low initial velocities of the engine piston 10 are satisfactory, the directional valve 70 may be of a very small design, so that rapid switching and low losses in the range of the directional valve 70 are realized on account of the low pressure medium flows. In switching position b, the axial bore 28 is relieved of pressure, so that the hydraulic piston 26 or the engine piston 10 may be further moved towards the inner dead center (IT) in the event of misfiring following switching.

Figure 9:
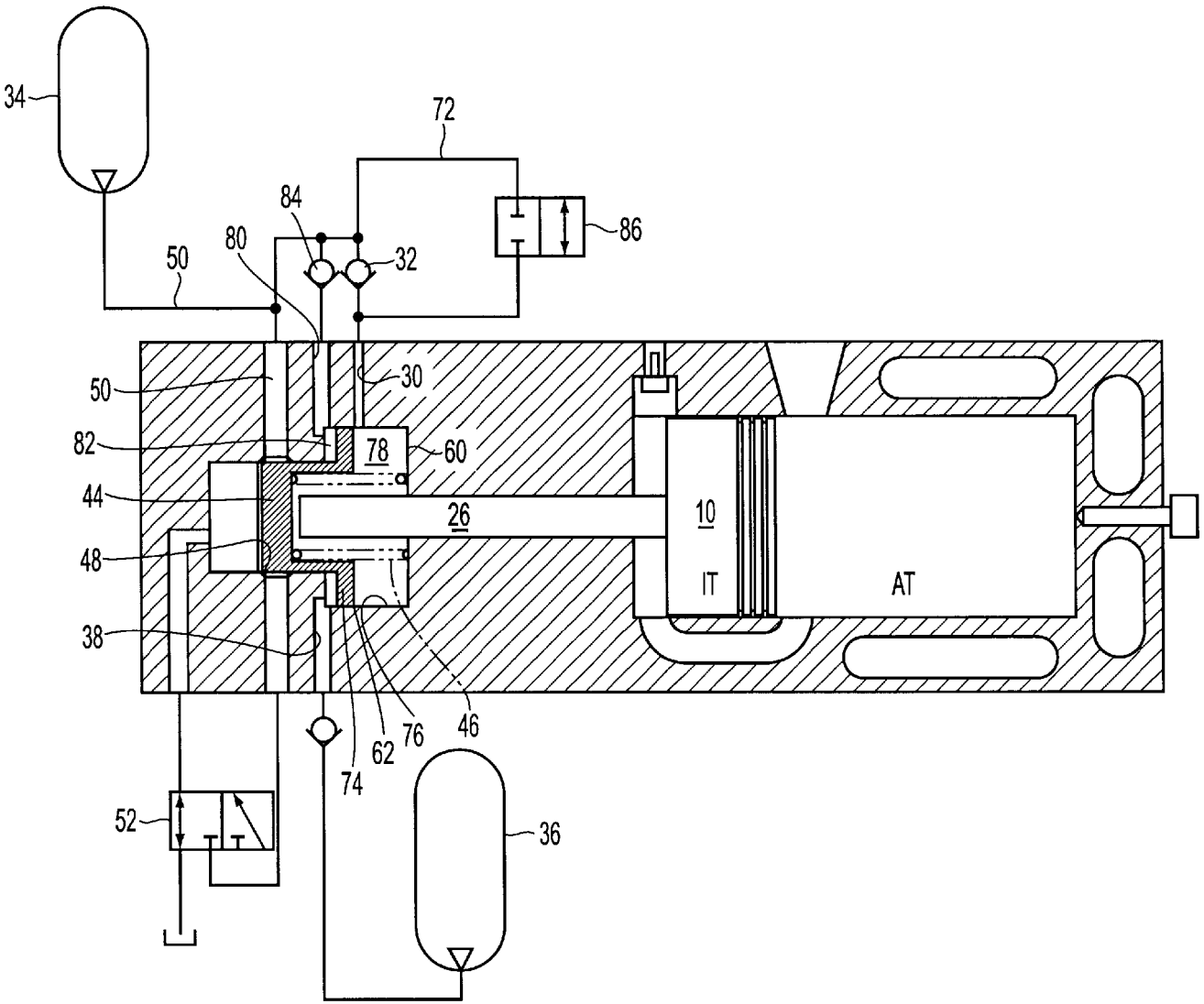
FIG. 9 shows a fourth embodiment of a free-piston engine having a control piston designed as a step piston.

In FIG. 9 a fourth embodiment is represented which corresponds to the second embodiment represented in FIG. 7 with respect to the basic structure. In other words, in the variant represented in FIG. 9, as well, the high-pressure passage 30 is controlled open and closed by a rear control land 62 of the control piston 44.

The essential difference in the embodiment represented in FIG. 9 is that the control piston 44 has the form of a step piston, with a radially expanded annular collar 74 being formed in a correspondingly expanded portion 76 of the control space 78 receiving the control piston 44.

In the closing position of the control piston 44, the high-pressure passage 30 opens into the space 78 defined by the larger end face of the control piston 44, whereas another pressure passage 80 opens into the annular space 82 defined by the annular end face of the step piston 44. This pressure passage 80 is connected with the high-pressure accumulator 84, with a check valve 34 preventing a flow from the high-pressure accumulator 84 into the annular space 82, similarly to the check valve 32 arranged in the high-pressure passage 30.

In the embodiment represented in FIG. 9 the check valve 32 may be bypassed via a bypass line 72 having arranged in it an apportioning valve 86, the function of which corresponds in principle to the directional valve 70 of the above described embodiment.

The low-pressure passage 38 establishing the connection with the low-pressure accumulator 36 equally opens into the annular space 82, so that the control piston 44 is subjected to the pressure in the low-pressure accumulator 36 in the direction of opening. The force provided by the control spring 46 accordingly must be adjusted so that it urges the control piston 44 against the valve seat 48 against the pressure in the low-pressure accumulator 36 while in a basic position.

For initiation of the compression stroke, the switchover valve 52 is taken into the work position, so that the control piston 44 rises from the valve seat 48, and both the hydraulic piston 26 and the engine piston 10 are accelerated. During the displacement of the control piston 44, pressure medium is drawn in from the low-pressure accumulator 36 via the low-pressure passage 38, so that the opening movement is supported by a pressure from the low-pressure accumulator 36.

Where this should be necessary for compensating friction losses, temperature changes etc., it is possible to directly apply a pressure from the hydraulic accumulator 34 to the hydraulic piston 26 via the apportioning valve 36, similar to the above described third embodiment.

In the represented fourth embodiment, the stop 60 is formed in such an axial spacing from the control piston 44 that during operation of the free-piston engine 1, the control piston 44 is stopped in its terminal position when viewed in the direction of opening by an equilibrium of forces, instead of contacting a stop. This terminal position of the control piston 44 is reached when the engine piston 10 reaches its outer dead center AT.

As a result of the equilibrium of forces, the engine piston 10 comes to a standstill at the outer dead center AT, and as a result of injection of fuel through the injection valve 24, ignition of the mixture takes place: the engine piston 10 and the control piston 44 move back into their basic positions. On account of the return movement of the control piston 44, the pressure medium present in the annular space 82 is conveyed via the pressure passage 80 and the check valve 84 into the high-pressure accumulator 34, whereby the latter is charged. Following a predetermined axial displacement of the control piston 44, the high-pressure passage 30 is controlled open via the control land 62 of the control piston 44, so that shortly before the control piston 44 contacts the valve seat 48, the kinetic energy of the engine piston 10 is utilized for charging the hydraulic accumulator 34 via the high-pressure passage 30 and the check valve 32. After the control piston 44 contacts the valve seat 48, switchover valve 52 is switched, so that the smaller end face of the control piston 44 is relieved towards the reservoir or towards low pressure, respectively—the engine cycle may start anew.

Figure 10:
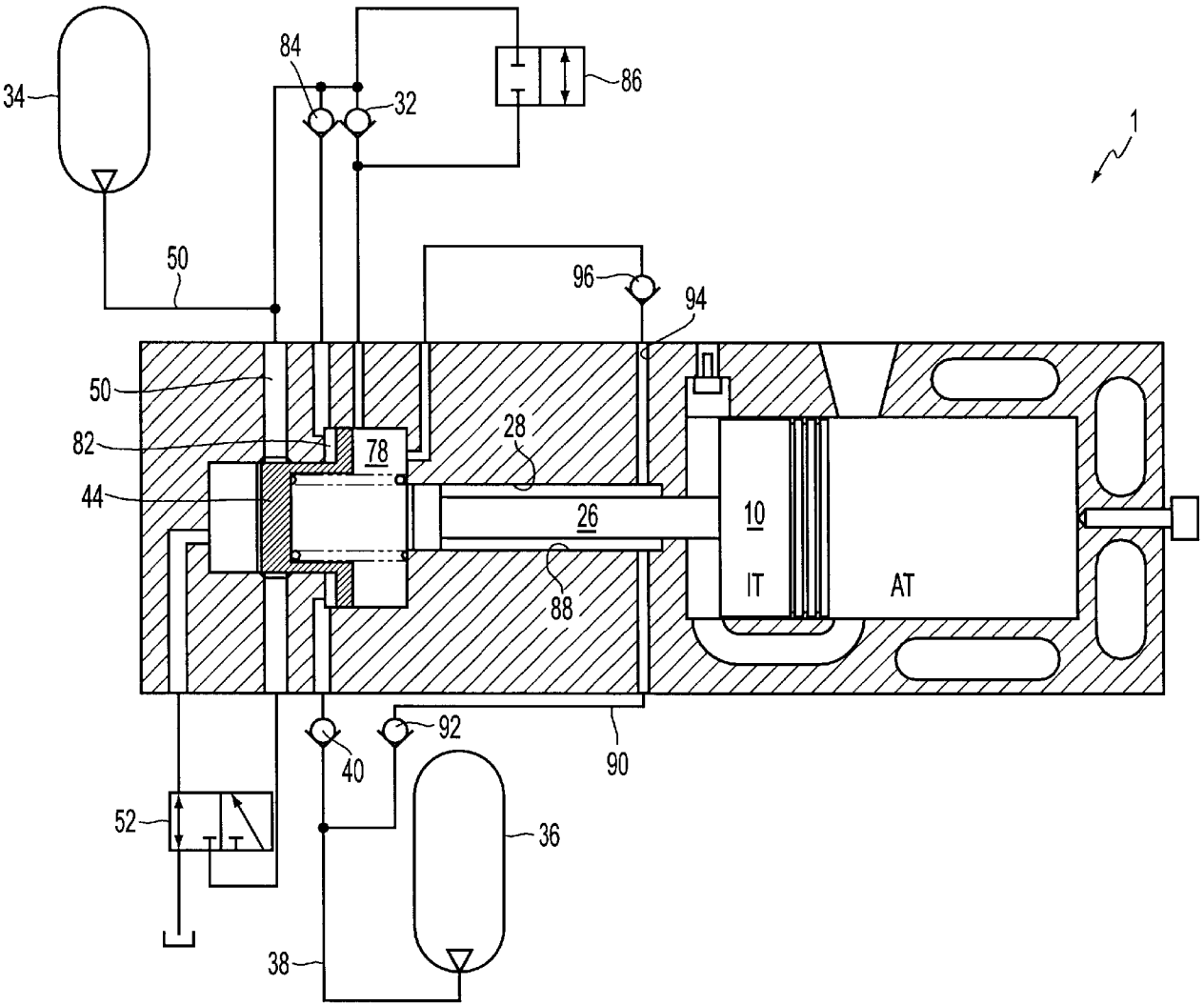
FIG. 10 shows a variant of the free-piston engine in accordance with FIG. 9 including a hydraulic piston designed as a differential cylinder.

FIG. 10 shows a variant of the fourth embodiment represented in FIG. 9, where the working or hydraulic piston 26 is in the form of a differential piston, with the radially set-back portion being oriented towards the engine piston 10. The radially set-back portion of the hydraulic piston 26, together with the axial bore 28, forms another annular space 88 which is connected to the low-pressure accumulator 36 via a low-pressure line 90 and a check valve 92, and with the space 78 defined by the larger end face of the control piston 44 via the connection passage 94 and a check valve 96. During the compression stroke the pressure medium present in the annular space 88 is displaced towards the space 78 via the connection passage 94 and the check valve 96. Upon the return movement of the engine piston 10 towards the inner dead center IT, pressure medium is drawn from the low-pressure accumulator 36 into the annular space 88 via the low-pressure line 90 and the check valve 92. In other words, pressure medium may flow into the space 78 in contact with the control piston during the compression stroke, whereas during the expansion stroke, pressure medium may flow from the low-pressure accumulator 36 into the annular space 88. The particular advantage in comparison with the above described patent thus resides in the fact that the pressure medium may flow from the low-pressure accumulator 36 into the annular space 82 via the low-pressure passage 38 and the check valve 40 during the compression stroke, and into the annular space 88 via low-pressure line 90 and check valve 92 during the expansion stroke. The pressure medium column thus need not be stopped in the dead center of the engine piston 10 but may circulate virtually freely, so that the efficiency of the free-piston engine 1 is improved in comparison with the solution represented in FIG. 9.

Figure 11:
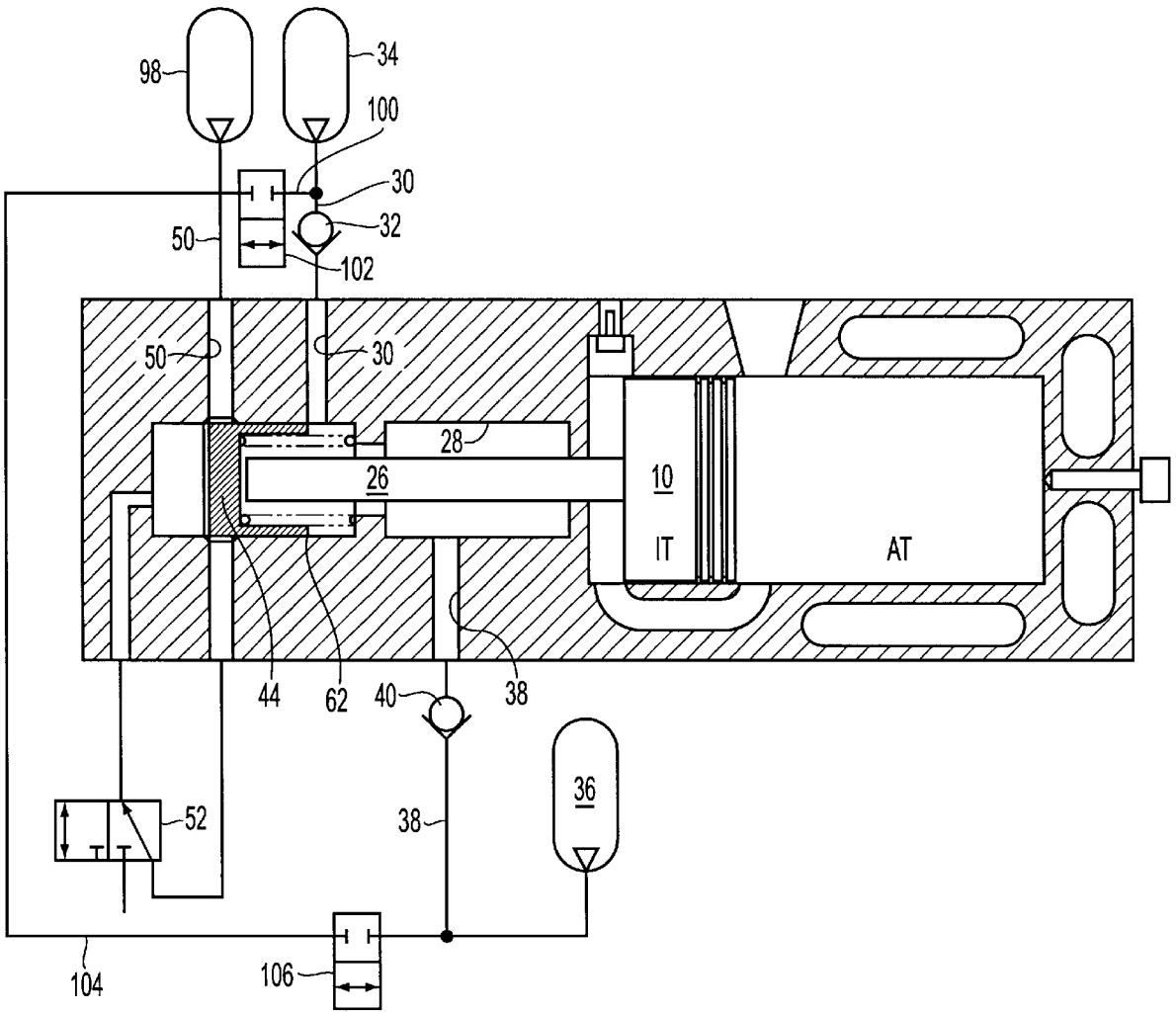
FIG. 11 shows a fifth embodiment of a free-piston engine including a medium-pressure accumulator.

In FIG. 11, finally, a fifth embodiment is represented which corresponds to the second embodiment represented in FIG. 7 with regard to the basic engine structure. In the variant represented in FIG. 11, apart from the high-pressure accumulator 34 and the low-pressure accumulator 36, an additional medium-pressure accumulator 98 is provided which is connected to the pressure passage 50, so that the left-hand end face of the control piston 44 in FIG. 11 is subjected to a pressure from the medium-pressure accumulator 98 when the holding valve 52 is taken to its work position. The medium-pressure accumulator 98 is connected to the part of the high-pressure passage 30 located downstream from the check valve 32 via a line 100 including a control valve 102. Correspondingly, the medium-pressure accumulator 98 is connected with the low-pressure accumulator 36 through the intermediary of another line 104 and another control valve 106.

In the solution represented in FIG. 11, the high-pressure accumulator 34 is connected to the high-pressure passage 30 via the check valve 32, with the high-pressure passage being controlled open during the return movement of the control piston 44 from its stop position through the control land 62.

The pressure level of the medium-high pressure accumulator 98 exists between those of the high-pressure accumulator 34 and of the low-pressure accumulator 36. In the basic position the two control valves 102 and 106 are closed, so that upon switching the switchover valve 52 into its work position, the end face of the control piston 44 is subjected to the pressure in the medium-high pressure accumulator 98. In other words, the acceleration of the engine piston 10 essentially depends on a pressure from the medium-high pressure accumulator 98. This pressure may be kept on a constant level through suitable control of the control valves 102, 106.

When the pressure in the medium-high pressure accumulator 98 drops below a predetermined level, the control valve 102 is controlled open, so that the medium pressure accumulator 98 is charged via the high-pressure accumulator 34. When the predetermined pressure level is exceeded, the other control valve 106 is controlled open, so that pressure may be relieved towards the low-pressure accumulator 36. During the expansion stroke, the high-pressure accumulator 34 is charged after controlling open the high-pressure passage 30. Thanks to the solution of embodiment five, the pressure supply for the free-piston engine is essentially independent of external influences and pressure fluctuations in the high-pressure accumulator 34 which may occur, e.g., upon actuation of further consumers connected to this high-pressure accumulator 34.

The above described variants including the directional valve 70 for directly applying pressure to the hydraulic piston 26, the medium-high pressure accumulator 98, the control piston 44 designed as a step piston, and the hydraulic piston 26 designed as a differential piston, may practically be combined in any desired manner, so that the invention certainly is not restricted to the above described embodiments.

What is disclosed is a free-piston engine, the engine piston of which may receive application of a force in the direction of compression via a hydraulic cylinder. The latter may be communicated with the pressure in a high-pressure accumulator means or in a low-pressure accumulator via a switchover valve. In accordance with the invention, there is provided between the hydraulic cylinder and the switchover valve a valve assembly including a control piston, wherein a connection to the high-pressure accumulator means may be controlled open with the aid of the control land of the control piston.

What is claimed is:

1. Free-piston engine having an engine piston and a hydraulic piston cooperating with the engine piston, to which hydraulic piston a pressure in a high-pressure accumulator means or in a low-pressure accumulator is capable of being applied with the aid of a switchover valve, wherein between said hydraulic piston and said switchover valve a transformer valve assembly including a control piston is arranged, wherein a connection to said high-pressure accumulator means is capable of being controlled open via a control land of said control piston, and that said control piston receives application of a pressure in a hydraulic cylinder and the force of a control spring in a closing direction, and an output pressure from the switchover valve or a pressure from said high-pressure accumulator means in an opening direction, wherein a stroke of said control piston in the opening direction is limited by a stop before termination of the stroke of said hydraulic piston.

2. The free-piston engine in accordance with claim 1, wherein a piston area of said control piston is greater than the effective cross-section of said hydraulic piston.

3. The free-piston engine in accordance with claim 1, wherein said hydraulic cylinder is capable of being connected to said high-pressure accumulator means via a high-pressure passage and to said low-pressure accumulator via a low-pressure passage, with two check valves, one of said check valves preventing a return flow from said high-pressure accumulator means and the other of said check valves into said low-pressure accumulator, respectively.

4. The free-piston engine in accordance with claim 3, wherein said check valve arranged in said high-pressure passage is capable of being bypassed via a bypass line which is capable of being bypassed or closed with the aid of a directional valve.

5. The free-piston engine in accordance with claim 4, wherein said directional valve has a switching position in which said bypass line is capable of being connected to a reservoir.

6. The free-piston engine in accordance with claim 3, wherein said high-pressure passage is capable of being controlled open via a second control land of said control piston.

7. The free-piston engine in accordance with claim 1, wherein said control piston is a step piston, and an annular space defined by an annular end face of said control piston is capable of being connected both with said low-pressure accumulator and with said high-pressure accumulator means.

8. The free-piston engine in accordance with claim 7, wherein said high-pressure passage opens into a space defined by the larger end face of said control piston.

9. The free-piston engine in accordance with claim 3, wherein said high-pressure accumulator means includes a medium-pressure accumulator and a high-pressure accumulator interconnectable via a line and a control valve, the one end face of said control piston acting in the opening direction being capable of receiving application of a pressure from said medium-high pressure accumulator.

10. The free-piston engine in accordance with claim 9, wherein said medium-pressure accumulator is capable of being connected to said low-pressure accumulator via a further connecting line and a further control valve.

11. The free-piston engine in accordance with claim 3, wherein said high-pressure passage is connected to said high-pressure accumulator.

12. The free-piston engine in accordance with claim 1, wherein said transformer valve assembly is arranged coaxial with the engine piston axis.

* * * * *